US006188374B1

(12) United States Patent
Moon

(10) Patent No.: US 6,188,374 B1
(45) Date of Patent: Feb. 13, 2001

(54) PLASMA DISPLAY PANEL AND DRIVING APPARATUS THEREFOR

(75) Inventor: Seong Hak Moon, Kyunggi-Do (KR)

(73) Assignee: LG Electronics, Inc., Seoul (KR)

( * ) Notice: Under 35 U.S.C. 154(b), the term of this patent shall be extended for 0 days.

(21) Appl. No.: 09/048,310

(22) Filed: Mar. 26, 1998

(30) Foreign Application Priority Data

Mar. 28, 1997 (KR) ..... 9-11114
Mar. 28, 1997 (KR) ..... 9-11115

(51) Int. Cl.[7] ..... G09G 3/28

(52) U.S. Cl. ..... 345/60; 345/62; 345/66; 345/67; 345/68; 345/72

(58) Field of Search ..... 345/60, 61, 67, 345/66, 68, 62, 72

(56) References Cited

U.S. PATENT DOCUMENTS 3,990,068 * 11/1976 Mayer et al. ..... 345/67
4,044,349 * 8/1977 Andoh et al. ..... 345/61
4,045,790 * 8/1977 Miller ..... 345/67
4,924,218 * 5/1990 Weber et al. ..... 345/67
5,661,000 * 8/1997 Shinoda et al. ..... 345/60
5,745,086 * 4/1998 Weber ..... 345/60
5,835,072 * 11/1998 Kanazawa ..... 345/60
5,867,135 * 2/1999 Salavin et al. ..... 345/68
5,952,986 * 9/1999 Nguyen et al. ..... 345/68
6,084,559 * 7/2000 Nagao et al. ..... 345/67
6,118,214 * 9/2000 Marcotte ..... 313/582

FOREIGN PATENT DOCUMENTS 5-266800 10/1993 (JP) .

* cited by examiner

*Primary Examiner*—Richard A. Hjerpe
*Assistant Examiner*—Henry N. Tran
(74) *Attorney, Agent, or Firm*—Fleshner & Kim, LLP

(57) ABSTRACT

A plasma display panel that is adapted to reduce the power consumption and the EMI and to prolong a life thereof. In the panel, common terminals are used in first and second sustain electrode lines arranged on a pixel cell matrix to keep a discharge in pixel cells. The common terminals simultaneously apply a driving signal to each of two sustain electrode lines, thereby charging electric charges in next line pixel cells during maintaining the discharge at one line pixel cells.

18 Claims, 7 Drawing Sheets

PLASMA DISPLAY PANEL AND DRIVING APPARATUS THEREFOR

BACKGROUND OF THE INVENTION

1. Field of the Invention

This invention relates to a display device, and more particularly to an improved plasma display panel (PDP) for displaying a picture with the aid of a discharge caused by an alternating current voltage signal. Also, this invention is directed to an improved driving apparatus for the PDP.

2. Description of the Prior Art

Generally, display panels include a cathode ray tube (CRT), a liquid crystal display panel, a plasma display panel (PDP) and so on. The CRT has disadvantages in that its operational voltage is relatively high and that it is difficult to obtain a large-scale screen and a flat screen. The liquid crystal panel has inferior optical characteristics. Otherwise, in comparison to them, the PDP has advantages in that it is not only easy to obtain a large-scale screen and a flat screen, but also it has superior optical characteristics. Recently, the PDP has prevailed in the market owing to such advantages. Further, a plasma display apparatus employing the PDP controls a discharging interval for each picture element or pixel on the PDP, thereby to display moving pictures or still pictures. This plasma display apparatus, however, has a complex circuit configuration and experiences a severe electromagnetic interference, depending upon an electrode structure in the PDP.

An example of a conventional alternating current plasma display apparatus having such drawbacks is shown in FIG. 1. Referring to FIG. 1, the alternating current plasma display apparatus includes a PDP 10 having m×n pixels arranged in a matrix pattern, and a microcomputer 20 for converting picture data containing red (R), green (G), and blue (B)pixel data into panel picture data and for generating control signals. As shown in FIG. 2, each of m×n pixels included in the PDP 10 is composed of three color pixel cells, i.e., R, G, and B pixel cells. Thus, the PDP 10 includes m×3n color pixel cells.

Referring now to FIG. 2, the m×3n color pixel cells are divided by a compartment wall 13 in a shape of matrix disposed between an upper substrate 11 and a lower substrate 12. The compartment wall 13 provides a discharging space for each m×n color pixel cells. In the upper substrate 11, as shown in FIG. 3, m Y sustain electrodes YE1, YE2, . . . , YEm arranged in parallel with respect to the vertical axis and m Z sustain electrodes ZE1, ZE2, . . . , ZEm arranged in an alternate pattern with respect to the Y sustain electrodes YE1, YE2, . . . , YEm are defined in such a manner to be unoverlapped with the compartment wall 13. Thus, one Y sustain electrode YE and one Z sustain electrode ZE are positioned at the upper portion of color pixel cells in one raw, i.e., one raw of discharging spaces. On the other hand, in the lower substrate 13, as shown in FIG. 3, n R, G, and B address electrodes RE1, GE1, BE1, RE2, GE2, . . . , BEn-1, REn, GEn, BEn are defined in a mutually alternate pattern in such a manner to be unoverlapped with the compartment wall 13. As a result, one R, G or B address electrode RE, GE or BE is positioned at the lower portion of color pixel cells in one column. Each R, G and B address electrodes RE1, GE1, BE1, RE2, GE2, . . . , BEn-1, REn, GEn, BEn causes a discharge between the Y sustain electrodes YE1, YE2, . . . , YEm and the Z sustain electrodes ZE1, ZE2, . . . , ZEm. Also, each Y sustain electrode YE1, YE2, . . . , YEm keeps the discharge caused between it and the Z sustain electrodes ZE1, ZE2, . . . , ZEm corresponding thereto. A dielectric material layer 15 and a MgO protective film 16 is sequentially disposed on the upper substrate 11 in which Y and Z sustain electrodes YE1, YE2, . . . , YEm and ZE1, ZE2, . . . , ZEm are formed. The dielectric material layer 15 is responsible for limiting a discharge current in each color pixel cell. The protective film 16 is responsible for protecting the dielectric material layer 15 and the Y and Z sustain electrodes YE1, YE2, . . . , YEm and ZE1, ZE2, . . . , ZEm from a sputtering accompanied during discharging in each color pixel cell. A R fluorescent body layer 14A is formed on the surface of each R address electrode RE1, RE2, . . . , REm; a G fluorescent body layer 14B is formed at the upper portion of each G address electrode GE1, GE2, . . . , GEm; and a B fluorescent body layer 14C is formed on the surface of each G address electrode GE1, GE2, . . . , GEm. The R, G and B fluorescent body layers 14A, 14B and 14C are usually formed to reach the vicinity of the upper end of the compartment wall 13. A discharge gas 17 is injected into each of color pixel cells divided by the compartment wall 13, i.e., discharge spaces. This discharge gas emits a light 18 such as ultraviolet lays when a discharge is generated among the Y sustain electrode YE, the Z sustain electrode ZE, and/or the address electrode RE, GE or BE. The R, G and B fluorescent bodies 14A, 14B and 14C brightens by means of the light from the discharge gas 17, thereby displaying a picture on the PDP 10.

Returning to FIG. 1, panel picture data generated at the microcomputer 20 contains x subfield picture data SF1 to SFx for on frame picture data corresponding to a single picture. In other words, one frame field picture data consist of x subfield picture data SF1 to SFx. Each color pixel cell on the PDP 10 is discharged or undischarged by the subfield picture data SF. The x subfield picture data SF1 to SFx are made by separating x bits of R, G and B pixel data for each bit thereof. Thus, the first subfield picture data SF1 contain the least significant bits of R, G, and B pixel data; the second subfield picture data SF2 contain the next order significant bits of R, G, and B pixel data; and the x numbered subfield picture data SFx contain the most significant bits of R, G, and B pixel data.

Further, the plasma display apparatus includes a memory 30 for temporarily storing panel picture data from the microcomputer 20, and a Y sustain driver 40 and a Z sustain driver 50 for receiving control signals from the microcomputer 20. The memory 30 stores panel picture data while dividing the same for frame, for subfield (i.e., for bit) and for color thereof. The Y sustain driver 40 is responsive to the control signals from the microcomputer 20 to sequentially drive m Y sustain electrode lines YE1, YE2, . . . , YEm every subfield. Specifically, the Y sustain driver 40 applies an erase pulse to all the m Y sustain electrode lines YE1, YE2, . . . , YEm to thereby eliminate electric charges charged into a side wall 13 in the previous subfield, hereinafter referred to as "wall charges", and then applies a write pulse to all the m Y sustain electrode lines YE1, YE2, . . . , YEm to thereby uniformly charge wall charges into the side wall 13 of the PDP 10. Subsequently, the Y sustain driver 40 sequentially applies to the m Y sustain electrode lines YE1, YE2, . . . , YEm to thereby sequentially drive the color pixel cells on the PDP 10 for one line. To this end, the Y sustain driver 40 includes l Y driving integrated circuit (IC) chips. The l Y driving IC chips drive the m Y sustain electrode lines YE1, YE2, . . . , YEm while dividing them into three units. Likewise, the Z sustain driver 50 is responsive to the control signals from the microcomputer 20 to sequentially drive m Z sustain electrode lines ZE1, ZE2, . . . , ZEm every subfield. Specifically, the Z sustain driver 50 applies an erase pulse to all the m Z sustain electrode lines ZE1, ZE2, . . . , ZEm to thereby eliminate electric charges charged into the side wall in the previous subfield, that is, wall charges, and then applies a write pulse to all the m Y sustain electrode lines YE1, YE2, . . . , YEm to thereby uniformly charge wall charges into the side wall 13 of the PDP 10. Subsequently, the Z sustain driver 50 sequentially applies a sustain pulse to the m Z sustain electrode lines ZE1, ZE2, . . . , ZEm to thereby sequentially drive the color pixel cells on the PDP 10 for one line. To this end, the Z sustain driver 40 includes l Z driving IC chips. The l Z driving IC chips drive the m Z sustain electrode lines ZE1, ZE2, . . . , ZEm while dividing them into three units. Pulse signals generated at the Y sustain driver 40 has a contrary waveform to pulse signals at the Z sustain driver 50. Also, the sustain pulses generated at the Y sustain driver 40 and the sustain pulses generated at the Z sustain driver 50 have wavelengths incrementing by $2^n$ in proportion to a progress of the subfields. In other words, the sustain pulses have wavelengths of $2^0, 2^1, 2^2, \ldots, 2^{x-2}, 2^{x-1}$ in the 1st to xth subfields, respectively. A discharge generating between the Y sustain electrode line YE and the Z sustain electrode line ZE by the sustain pluses maintains for each interval corresponding to $2^0, 2^1, 2^2, \ldots, 2^{x-2}, 2^{x-1}$ in accordance with a progress of the subfields.

Furthermore, the plasma display apparatus includes first and second address driver 61 and 62 for divisionally receiving panel picture data from the memory 30. The first address driver 61 drives m times odd-numbered address electrode lines RE1, BE1, GE2, RE3, BE3, GE3, . . . , REn-1, BEn-1, Gn in the n R, G, and B address electrode lines RE1, GE1, BE1, RE2, GE2, . . . , BEn-1, REn, GEn, BEn. To this end, the first address driver 61 applies an erase pulse to all the odd-numbered address electrode lines RE1, BE1, GE2, RE3, BE3, GE3, . . . , REn-1, BEn-1, Gn every subfield to thereby form wall charges on the surface of the R, G, or B fluorescent material layers 14A, 14B and 14C included in each odd-numbered color pixel cell. Then, the first address driver 61 receives m times odd-numbered pixel data R1, B1, G2, R3, B3, . . . , Rn-1, Bn-1, Gn corresponding to the odd-numbered address electrode lines RE1, BE1, GE2, RE3, BE3, GE3, . . . , REn-1, BEn-1, Gn from the memory 30. This results from the Y sustain driver 40 and the Z sustain driver 50 driving m Y sustain electrode lines YE1, YE2, . . . , YEm and m Z sustain electrode lines ZE1, ZE2, . . . , ZEm sequentially for one line. In addition, each time the odd-numbered pixel data R1, B1, G2, R3, B3, . . . , Rn-1, Bn-1, Gn is inputted, the first address driver 61 selectively applies an address pulse to each odd-numbered address electrode lines RE1, BE1, GE2, RE3, BE3, GE3, . . . , REn-1, BEn-1, Gn in accordance with a logical value of each pixel data, thereby selectively causing a discharge in each discharge space of the odd-numbered color pixel cells. The address pulse is generated in such a manner to be synchronized with a scan pulse stream only when a logical value of the pixel data is "1" and applied to the address electrode line. The discharge selectively generating at each discharge space of the odd-numbered color pixel cells in the above manner is maintained during an interval in which the sustain pulse is applied to the Y sustain electrode line YE and the Z sustain electrode line ZE. During the interval maintaining the discharge, discharge gases 17 contained in each discharge space of the odd-numbered color pixel cells emit ultraviolet lays 18 to brighten the R, G and B fluorescent layers 14A, 14B and 14C. The ultraviolet rays 18 is generated when electrons included in gas particles are excited and then transited. The electrons are excited by absorbing an energy generated when gas particles collide with respect to each other. Likewise, the second address driver 62 drives m times even-numbered address electrode lines GE1, RE2, BE2, GE3, . . . , GEn-1, REn-1, Bn in the n R, G, and B address electrode lines RE1, GE1, BE1, RE2, GE2, . . . , BEn-1, REn, GEn, BEn. To this end, the second address driver 62 applies an erase pulse to all the even-numbered address electrode lines GE1, RE2, BE2, GE3, . . . , GEn-1, REn-1, Bn every subfield, to thereby form wall charges on the surface of the R, G, or B fluorescent material layers 14A, 14B and 14C included in each even-numbered color pixel cell. Then, the second address driver 62 receives m times even-numbered pixel data G1, R2, B2, G3, . . . , Gn-1, Rn, Bn corresponding to the even-numbered address electrode lines GE1, RE2, BE2, GE3, . . . , GEn-1, REn-1, Bn the memory 30. The first address driver 61 and the second address driver 62 generate an erase pulse in such a manner that the erase pulse is positioned between a write pulse generated at the sustain drivers 40 and 50 and the sustain pulse stream. In addition, each time the even-numbered pixel data G1, R2, B2, G3, . . . , Gn-1, Rn, Bn are inputted, the second address driver 62 selectively applies an address pulse to each even-numbered address electrode lines GE1, RE2, BE2, GE3, GEn-1, REn-1, Bn in accordance with a logical value of each pixel data, thereby selectively causing a discharge in each discharge space of the even-numbered color pixel cells. The discharge selectively generating at each discharge space of the even-numbered color pixel cells in the above manner is maintained during an interval in which a scan pulse stream is applied to the Y sustain electrode line YE and the Z sustain electrode line ZE. During the interval maintaining the discharge, discharge gases 17 contained in each discharge space of the even-numbered color pixel cells emit ultraviolet lays 18 to brighten the R, G and B fluorescent layers 14A, 14B and 14C. As a result, each even-numbered color pixel cell included in the PDP 10 selectively emits R, G or B lights through the lower glass substrate 12.

As described above, the color pixel cells included in the PDP 10 is selectively driven every subfield by means of the address drivers 61 and 62 and the sustain drivers 40 and 50, thereby generating R, G or B lights at each color pixel cell only during any one of $2^x$ intervals in an interval when a single picture is displayed, that is, in one frame interval. In other words, a total amount of the R, G or B lights generated during one frame interval at each color pixel cell included in the PDP 10 has any one of $2^x$ scale levels. Thus, $2^x$ gray levels of R, G or B are displayed on each color pixel cell and, therefore, $2^x$ gray levels of color picture is displayed on the PDP 10.

In the conventional plasma display apparatus as mentioned above, since a sustain pulse stream is sequentially applied to the sustain electrode lines at the PDP 10 in such a manner to be applied to one sustain electrode line, circuit configurations of the Y and Z sustain drivers becomes complicated and the frequency of the sustain pulse becomes high. Such a rise in the frequency of the sustain pulse in the conventional display apparatus results in a lot of power consumption as well as a shortened life of the PDP. Further, in the conventional plasma display apparatus, since the address electrode lines at the PDP is divided into the odd-numbered address electrode lines and the even-numbered address electrode lines and driven, all R, G and B pixel data must be supplied to each of the first address driver driving the odd-numbered address electrode lines and the second address driver driving the even-numbered address electrode lines. Due to this, a cross talk between data occurs at the data transfer path between the memory and the address driver and thus a noise caused by the cross talk between data is produced. As a result the conventional plasma display apparatus has an inferior picture quality.

As an alternative for simplifying the circuit configuration, a plasma display apparatus connecting all Z sustain electrode lines in parallel is disclosed in Japanese Laid-open Patent No. Puyng 5-266800. The plasma display apparatus in the Japanese Patent provides an advantage in that the Z sustain driver can be omitted. The display apparatus, however, allows a discharge current in each color pixel to be flow toward the same direction. Due to this, the display apparatus appears causes more severe electromagnetic interference.

SUMMARY OF THE INVENTION

Accordingly, it is an object of the present invention to provide a plasma display panel that is adapted to reduce a power consumption as well as to prolong a life thereof.

Further object of the present invention is to provide a plasma display apparatus that is capable of improve a picture quality.

Another object of the present invention is to provide a plasma display apparatus that is adapted to prolong a life of display panel, as well as to simplify a circuit configuration thereof and to reduce a power consumption.

Still another object of the present invention is to provide a plasma display apparatus that is capable of improving a picture quality.

In order to achieve these and other objects of the invention, according to one aspect of the present invention there is provided with a plasma display panel including a plurality of pixel cells arranged in a matrix pattern and utilizing a discharge; first and second sustain electrode lines arranged, in parallel, in a pair on the matrix to keep the discharge in the pixel cells; and signal transferring means for allowing electric charges to be charged in next line pixel cells during maintaining the discharge at one line of pixel cells.

According to another aspect of the present invention, there is provided with a plasma display panel including a plurality of pixel cells arranged in a matrix pattern and utilizing a discharge; first and second sustain electrode lines arranged, in parallel, in a pair on the matrix to keep the discharge in the pixel cells; red(R), green(G) and blue(B) address electrode lines arranged on the matrix in such a manner to be perpendicularly intersected with the first and second sustain electrode lines and correspond to each of the R, G and B pixel cells; first sink terminals for applying a driving signal to any one color address electrode lines and a part of other color address electrode lines of the R, G and B address electrode lines; and second sink terminals for applying a driving signal to any other color address electrode lines and a remainder of the other color address electrode lines of the R, G and B address electrode lines.

According to still another aspect of the present invention, there is provided with a plasma display apparatus including a plasma display panel having a plurality of pixel cells arranged in a matrix pattern and having first and second sustain electrode lines arranged on the matrix to keep a discharge in the pixel cells; and sustain driver means for driving the first and second sustain electrode lines in such a manner that electric charges are charged in next line pixel cells during maintaining the discharge at one line pixel cells.

According to still another aspect of the present invention, there is provided with a plasma display apparatus including a plasma display panel having a plurality of pixel cells arranged in a matrix pattern and utilizing a discharge, having first and second sustain electrode lines arranged on the matrix to keep a discharge in the pixel cells, and having R, G and B address electrode lines in such a manner to be perpendicularly intersected with the first and second electrode lines and to correspond to each of the R, G and B pixel cells; first address driver means for driving any one color address electrode lines and a part of other color address electrode lines of the R, G and B address electrode lines; and second address driver means for driving a driving signal to any other color address electrode lines and a remainder of the other color address electrode lines of the R, G and B address electrode lines.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 4:
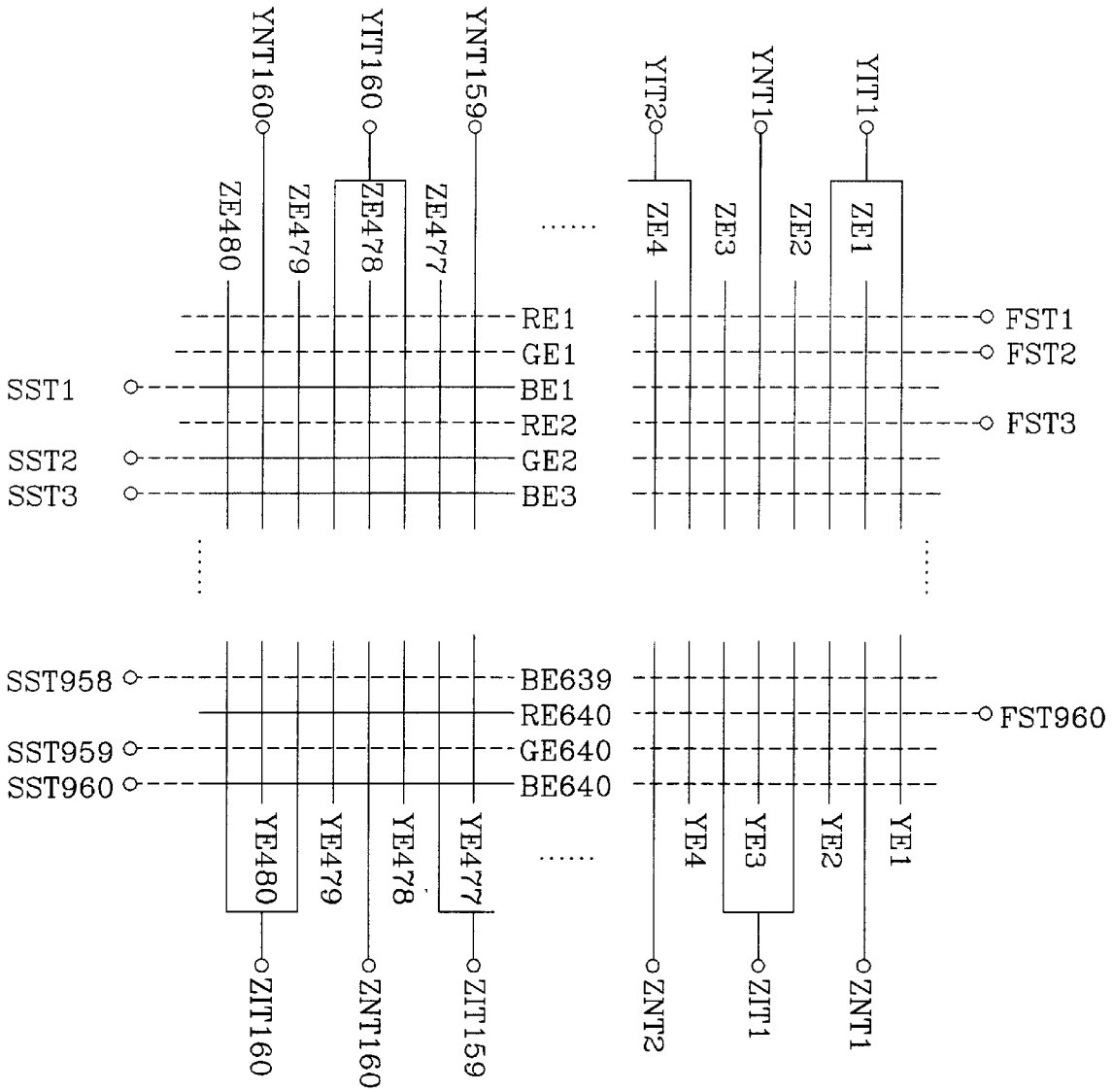
FIG. 4 is a detailed view of an electrode structure of a PDP according to an embodiment of the present invention.

Referring to FIG. 4, there is shown a PDP according to an embodiment of the present invention. The PDP includes 480 Y sustain electrode lines YE1, YE2, . . . , YE480 and 480 Z sustain electrode lines ZE1, ZE2, . . . , ZE480 that are arranged alternately. (3i−2)th Y sustain electrode lines YE1, YE4, . . . , YE478 in the 480 Y sustain electrode lines YE1, YE2, . . . , YE480 are connected, in parallel, to first common terminal YIT1, YIT2, . . . , YIT160 along with the next(3i−1)th Y sustain electrode lines YE2, YE5, . . . , YE479, respectively. The remaining Y sustain electrode lines YE3, YE6, . . . , YE480 are connected to first normal terminal YNT1 to YNT160, respectively. Each first common terminal YIT1 to YIT160 receives a sustain pulse having a period corresponding to twice the sustain pulse to be applied to each first normal terminal YNT1 to YNT160. Accordingly, a frequency of the sustain pulse for sequentially driving the 480 Y sustain electrode lines YE1 to YE480 is lowered to ⅔ times and, thus, a circuit configuration of the Y sustain driver driving the 480 Y sustain electrode lines YE1 to YE480 is simplified to ⅔ times. Likewise, (3i−1)th Z sustain electrode lines ZE2, ZE5, . . . , ZE479 in the 480 Z sustain electrode lines ZE1, ZE2, . . . , ZE480 are connected, in parallel, to second common terminal ZIT1, ZIT2, . . . , ZIT160 along with the next (3i)th Z sustain electrode lines ZE3, ZE6, . . . , ZE480, respectively. The remaining Z sustain electrode lines ZE3, ZE6, . . . , ZE480 are connected to second normal terminal ZNT1 to ZNT160, respectively. Each second common terminal ZIT1 to ZIT160 receives a sustain pulse having a period corresponding to twice the sustain pulse to be applied to each second normal terminal ZNT1 to ZNT160. Accordingly, a frequency of the sustain pulse for sequentially driving the 480 Z sustain electrode lines ZE1 to ZE480 is lowered to ⅔ times and, thus, a circuit configuration of the Z sustain driver driving the 480 Z sustain electrode lines ZE1 to ZE480 is simplified to ⅔ times. In such a sustain electrode structure, during applying a sustain pulse for keeping a discharge between the first Y sustain electrode line YE1 and the first Z sustain electrode line ZE1, wall charges are produced in color pixel cells at which the second Y sustain electrode line YE2 and the second Z sustain electrode line ZE2 are positioned. With the aid of the wall charge, a voltage of the sustain pulse for maintaining a discharge between the second Y sustain electrode line YE2 and the second Z sustain electrode line ZE2 becomes less than that of the sustain pulse applied to the first sustain electrode lines. In the similar manner, voltages of sustain pulses to be applied to the remaining 478 Y sustain electrode lines YE3 to YE480 and the remaining 478 Z sustain electrode lines ZE3 to ZE480 also are lowered. Accordingly, the PDP can be driven with a low voltage and is capable of reducing a power consumption.

Further, in the PDP, 640 R address electrode lines RE1 to RE640, 640 G address electrode lines GE1 to GE640, and 640 B address electrode lines BE1 to BE640 is alternately arranged with respect to each other and, at the same time, arranged in such a manner to be perpendicularly intersected with the Y and Z sustain electrode lines YE1 to YE480 and ZE1 to ZE480. The R address electrode lines RE1 to RE640 and the odd-numbered G address electrode lines GE1, GE3, . . . , GE639 in the 1920 address electrode lines RE1 to RE640, GE1 to GE640 and BE1 to BE640 are connected to first sink terminals FST1 to FST960, respectively, and the remaining B address electrode lines BE1 to BE640 and the even-numbered G address electrode lines GE2, GE4, . . . , GE640 are connected to second sink terminals SST1 to SSt960, respectively. The first sink terminals FST1 to FST960 are driven with R pixel data and odd-numbered G pixel data, and the second sink terminals SST1 to SSt960 are driven with B pixel data and even-numbered G pixel data. Accordingly, a signal wiring between pixel data sources and the first sink terminals FST1 to FST960 and a signal wiring between pixel data sources and the second sink terminals SST1 to SSt960 are simplified and, further, a cross talk between pixel data does not almost appear. As a result, a quality of a picture displayed on the PDP can be improved.

Figure 5:
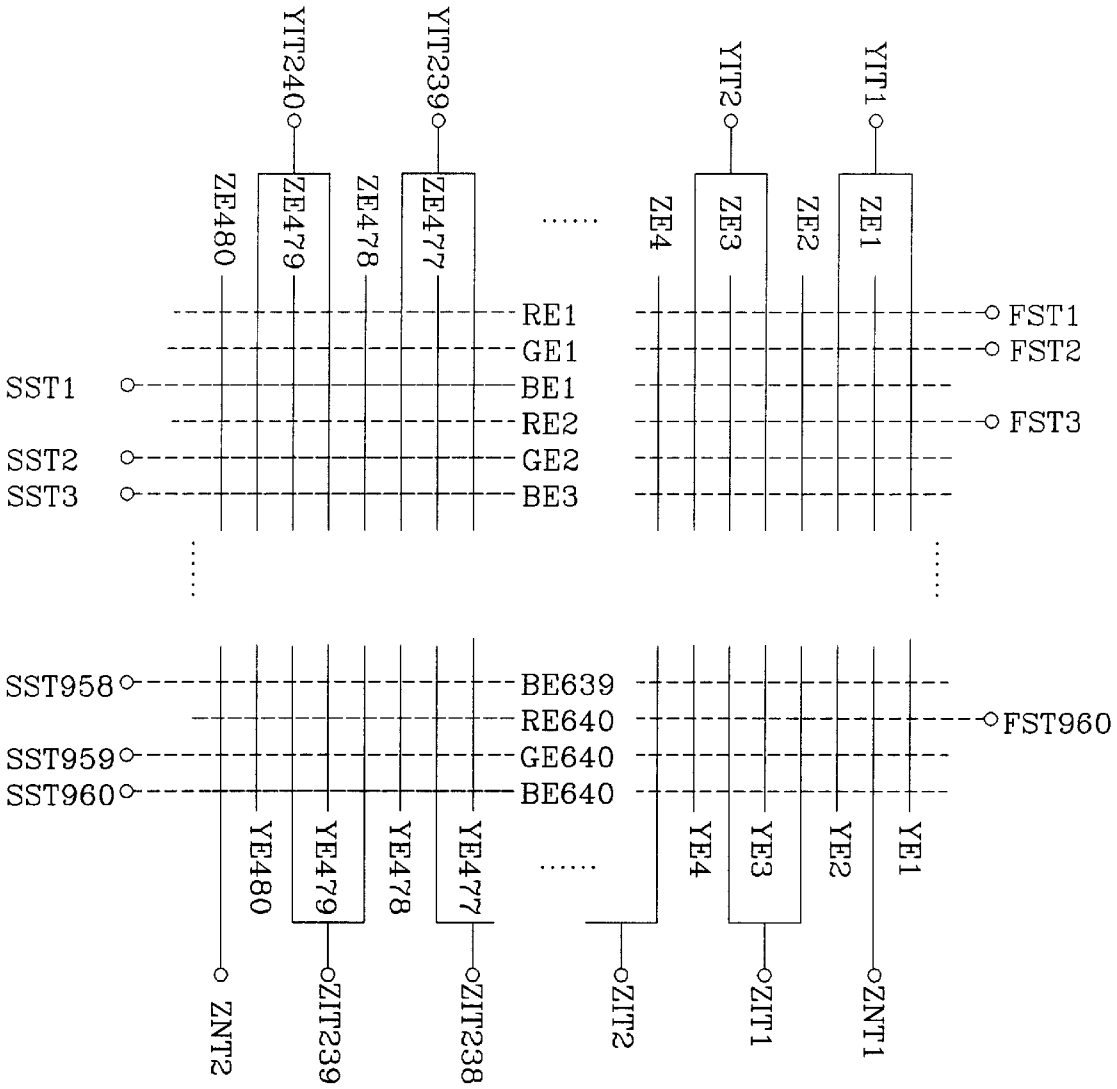
FIG. 5 is a detailed view of an electrode structure of a PDP according to another embodiment of the present invention.

Referring now to FIG. 5, there is shown a PDP according to another embodiment of the present invention. The PDP includes 480 Y sustain electrode lines YE1, YE2, . . . , YE480 and 480 Z sustain electrode lines ZE1, ZE2, . . . , ZE480 that are arranged alternately. The 480 Y sustain electrode lines YE1, YE, . . . , YE480 are connected, in parallel, to each of first common terminals YIT1, YIT2, . . . , YIT240 in two electrode line units. If the number of Y sustain electrode lines YE are odd number rather than 480, then the last sustain electrode line is connected to a first normal terminal, not shown. A sustain pulse applied to each first common terminal YIT1 to YIT240 has twice the period of a sustain pulse applied to the normal terminal. Accordingly, a frequency of the sustain pulse for sequentially driving the 480 Y sustain electrode lines YE1 to YE480 is lowered to ½ times and, thus, a circuit configuration of the Y sustain driver driving the 480 Y sustain electrode lines YE1 to YE480 is simplified to ½ times. The 2nd to 479th Z sustain electrode lines ZE2 to ZE479 in the 480 Z sustain electrode lines ZE1, ZE, . . . , ZE480 are connected to each of second common terminals ZIT1 to ZIT239 in two electrode line units; while the first and last Z sustain electrode lines ZE1 and ZE480 are connected to each of second normal electrode lines ZNT1 and ZNT2. Otherwise, if the number of Z sustain electrode line ZE is odd number rather than 480, then only the first Z sustain electrode line ZE1 is connected to the second normal terminal ZNT1. A sustain pulse applied to each second common terminal ZIT1 to ZIT239 has twice the period of a sustain pulse applied to each second normal terminal ZNT1 and ZNT2. Accordingly, a frequency of the sustain pulse for sequentially driving the 480 Z sustain electrode lines ZE1 to ZE480 is lowered to ½ times and, thus, a circuit configuration of the Z sustain driver driving the 480 Z sustain electrode lines ZE1 to ZE480 is simplified to ½ times. In such a sustain electrode structure, during applying a sustain pulse for keeping a discharge between the first Y sustain electrode line YE1 and the first Z sustain electrode line ZE1, wall charges are produced in color pixel cells at which the second Y sustain electrode line YE2 and the second Z sustain electrode line ZE2 are positioned. With the aid of the wall charge, a voltage of the sustain pulse for maintaining a discharge between the second Y sustain electrode line YE2 and the second Z sustain electrode line ZE2 becomes less than that of the sustain pulse applied to the first sustain electrode lines. In the similar manner, voltages of sustain pulses to be applied to the remaining 478 Y sustain electrode lines YE3 to YE480 and the remaining 478 Z sustain electrode lines ZE3 to ZE480 also are lowered. Accordingly, the PDP can be driven with a low voltage and is capable of reducing a power consumption.

Further, in the PDP, 640 R address electrode lines RE1 to RE640, 640 G address electrode lines GE1 to GE640, and 640 B address electrode lines BE1 to BE640 is alternately arranged with respect to each other and, at the same time, arranged in such a manner to be perpendicularly intersected with the Y and Z sustain electrode lines YE1 to YE480 and ZE1 to ZE480. The R address electrode lines RE1 to RE640 and the odd-numbered G address electrode lines GE1, GE3, . . . , GE639 in the 1920 address electrode lines RE1 to RE640, GE1 to GE640 and BE1 to BE640 are connected to first sink terminals FST1 to FST960, respectively, and the remaining B address electrode lines BE1 to BE640 and the even-numbered G address electrode lines GE2, GE4, . . . , GE640 are connected to second sink terminals SST1 to SST960, respectively. The first sink terminals FST1 to FST960 are driven with R pixel data and odd-numbered G pixel data, and the second sink terminals SST1 to SSt960 are driven with B pixel data and even-numbered G pixel data. Accordingly, a signal wiring between pixel data sources and the first sink terminals FST1 to FST960 and a signal wiring between pixel data sources and the second sink terminals SST1 to SSt960 are simplified and, further, a cross talk between pixel data does not almost appear. As a result, a quality of a picture displayed on the PDP can be improved.

Figure 1:
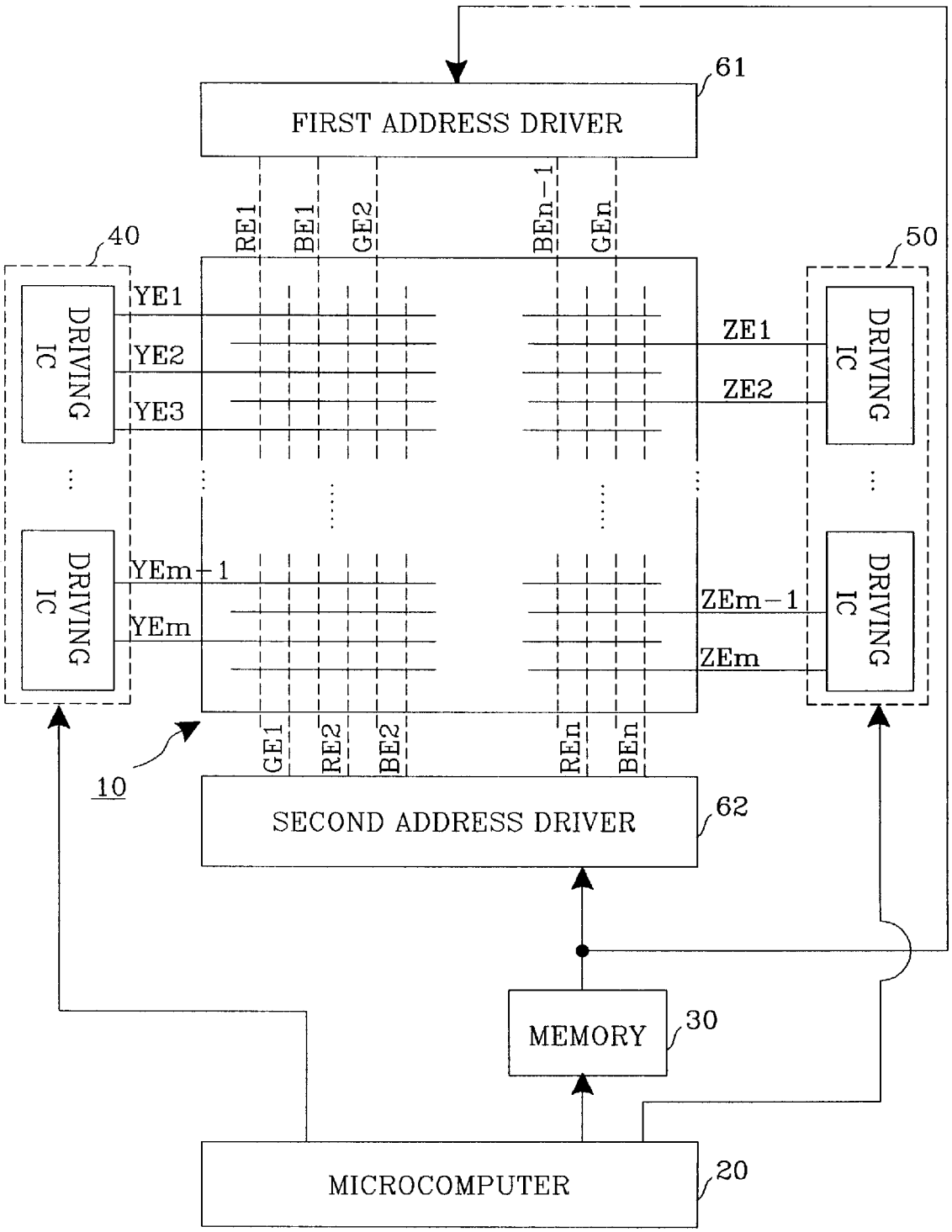
FIG. 1 PRIOR ART
FIG. 1 is a schematic view showing a configuration of a conventional plasma display apparatus.
Figure 2:
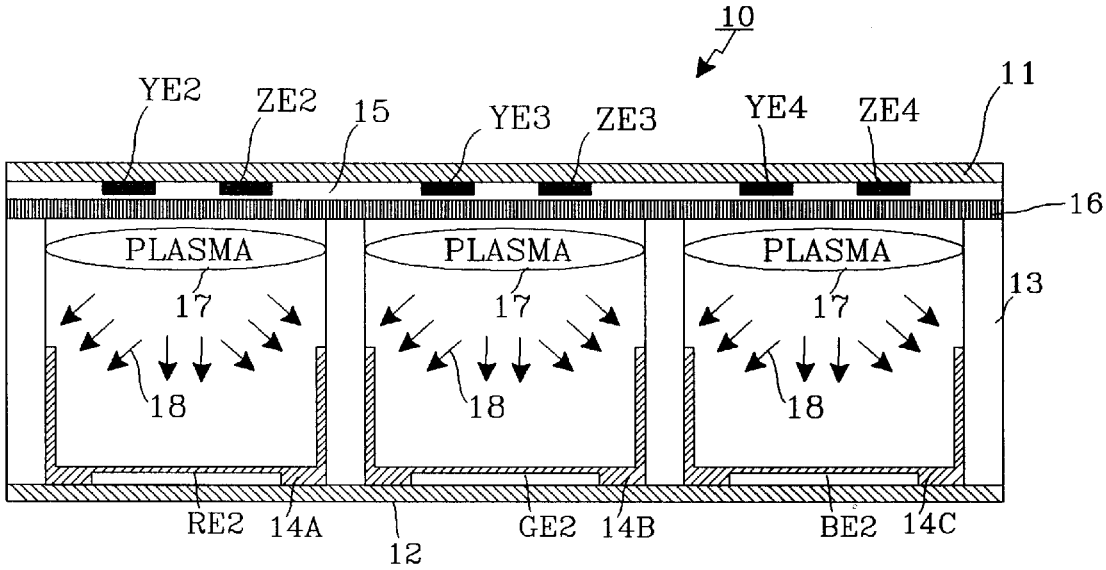
FIG. 2 PRIOR ART
FIG. 2 is a sectional view showing a structure of color pixel cells included in the PDP in FIG. 1.
Figure 3:
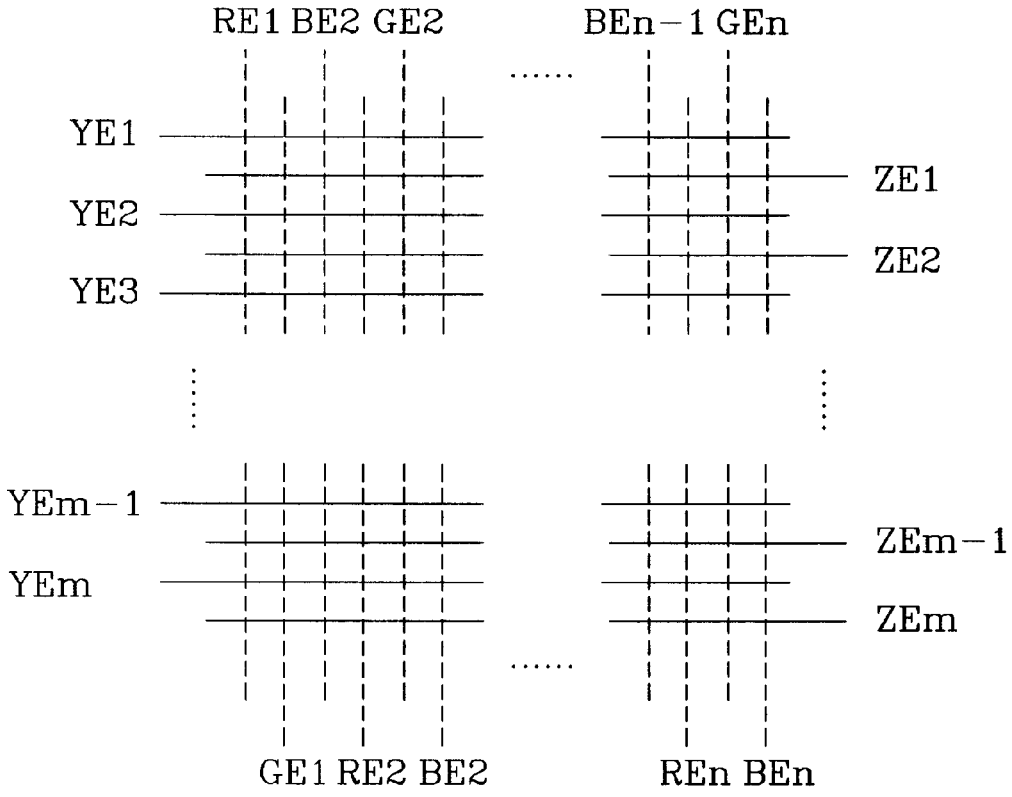
FIG. 3 PRIOR ART
FIG. 3 is a detailed view of an electrode structure of the PDP in FIG. 1.
Figure 6:
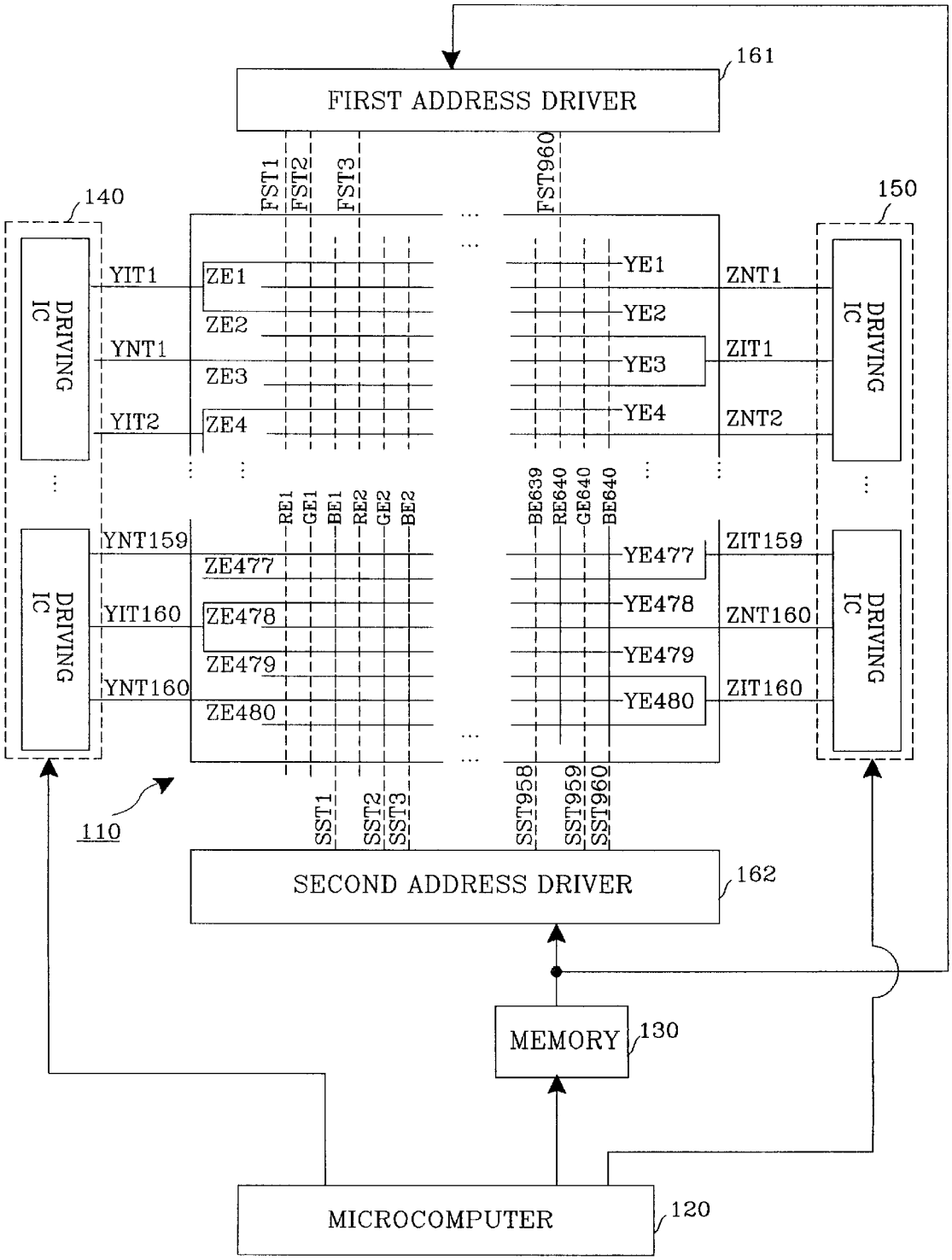
FIG. 6 is a schematic view showing a configuration of a plasma display apparatus according to an embodiment of the present invention.

Referring to FIG. 6, there is shown a plasma display apparatus according to an embodiment of the present invention. The plasma display apparatus includes a PDP 110 having 480×640 pixels arranged in a matrix pattern, and a microcomputer 120 for receiving picture data containing red (R), green (G), and blue (B) pixel data. As shown in FIG. 2, each of 480×640 pixels included in the PDP 110 is composed of three color pixel cells, i.e., R, G, and B pixel cells. Thus, the PDP 110 includes 480×1920 color pixel cells. The PDP 110 further includes 480 Y sustain electrode lines YE1 to YE480 and 480 Z sustain electrode lines ZE1 to ZE480, and 680 R, G and B address electrode lines RE1 to RE680, GE1 to GE680 and BE1 to BE680, configured as shown in FIG. 4. A detailed explanation as to the PDP 110 will be omitted because it can be sufficiently supported by the foregoing explanations with reference to FIG. 2 and FIG. 4. Herein, it is assumed that each R, G and B pixel data inputted to the microcomputer 120 is composed of 8 bits. The microcomputer 120 converts the picture data into panel picture data and generates control signals. The panel picture data generated at the microcomputer 120 contains 8 subfield picture data SF1 to SF8 for one frame picture data corresponding to a single picture. In other words, one frame field picture data consist of 8 subfield picture data SF1 to SF8. Each color pixel cell on the PDP 110 is discharged or undischarged by the subfield picture data SF. The 8 subfield picture data SF1 to SF8 are made by separating 8 bits of R, G and B pixel data for each bit thereof by means of the microcomputer 120. Thus, the first subfield picture data SF1 contain the least significant bits of R, G, and B pixel data; the second subfield picture data SF2 contain the next order significant bits of R, G, and B pixel data; and the 8th subfield picture data SF8 contain the most significant bits of R, G, and B pixel data.

Further, the plasma display apparatus includes a memory 130 for temporarily storing the panel picture data from the microcomputer 120, and a Y sustain driver 140 and a Z sustain driver 150 for receiving control signals from the microcomputer 20. The memory 130 stores panel picture data while dividing the same for frame, for subfield (i.e., for bit) and for color thereof. The Y sustain driver 140 is responsive to the control signals from the microcomputer 120 to sequentially drive 480 Y sustain electrode lines YE1, YE2, . . . , YE480 every subfield. Specifically, the Y sustain driver 140 applies an erase pulse to all of first 160 common terminals YIT1 to YIT160 and first 160 normal terminals YNT1 to YNT160 to thereby eliminate wall charges charged into a side wall of each color pixel cell in the previous subfield, and then applies a write pulse to all the first 160 common terminals YIT1 to YIT160 and first 160 normal terminals YNT1 to YNT160 to thereby uniformly form wall charges in the side wall of the PDP 110. Subsequently, the Y sustain driver 140 sequentially applies a sustain pulse to the first 160 common terminals YIT1 to YIT160 and first 160 normal terminals YNT1 to YNT160 to thereby sequentially drive the color pixel cells on the PDP 110 for one line. The sustain pulse applied to each first common terminals YIT1 to YIT160 is commonly transferred to two Y sustain electrode lines YE1, YE2, YE4, YE5, . . . , YE478, YE479. On the other hand, the sustain pulse applied to each first normal terminals YNT1 to YNT160 is transferred to only one Y sustain electrode lines YE3, YE6, . . . , YE480. Also, the sustain pulse applied to each first common terminals YIT1 to YIT160 has twice the period of each sustain pulse applied to each first normal terminals YNT1 to YNT160. To this end, the Y sustain driver 140 includes 107 Y driving IC chips. The 160 Y driving IC chips drive the 320 terminals YIT1 to YIT160 and YNT1 to YNT160 while dividing them into three units. Likewise, the Z sustain driver 150 is responsive to the control signals from the microcomputer 120 to sequentially drive 480 Z sustain electrode lines ZE1, ZE2, . . . , ZE480 every subfield. Specifically, the Z sustain driver 150 applies an erase pulse to all of second 160 common terminals ZIT1 to ZIT160 and second 160 normal terminals ZNT1 to ZNT160 to thereby eliminate wall charges charged into a side wall of each color pixel cell in the previous subfield, and then applies a write pulse to all the second 160 common terminals ZIT1 to ZIT160 and second 160 normal terminals ZNT1 to ZNT160 to thereby uniformly form wall charges in the side wall of the PDP 110. The erase pulse and the write pulse generated at the Y sustain driver 140 has a contrary waveform to those generated at the Z sustain driver 150. the Z sustain driver 150 sequentially applies a sustain pulse to the second 160 common terminals ZIT1 to ZIT160 and second 160 normal terminals ZNT1 to ZNT160 to thereby sequentially drive the color pixel cells on the PDP 110 for one line. The sustain pulse applied to each second common terminal ZIT1 to ZIT160 is commonly transferred to two Z sustain electrode lines ZE2, ZE3, ZE5, ZE6, . . . , ZE479, ZE480 connected in parallel. On the other hand, the sustain pulse applied to each second normal terminal ZNT1 to ZNT160 is transferred to only one Z sustain electrode lines ZE1, ZE4, . . . , ZE478. Also, the sustain pulse applied to each second common terminals ZIT1 to ZIT160 has twice the period of each sustain pulse applied to each second normal terminal ZNT1 to ZNT160. The sustain pulse generated at the Z sustain driver 150 has a contrary waveform to the sustain pulse generated at the Y sustain driver 140. To this end, the Z sustain driver 150 includes 107 Z driving IC chips. The 107 Z driving IC chips drive the 320 terminals YIT1 to YIT160 and YNT1 to YNT160 while dividing them into three units. In this case, if sustain pulses having a contrary waveform and a different width are applied to the first-numbered first common terminal YIT1 and the first-numbered second normal terminal ZNT1, that is, if color pixel cells on the first line are driven, then a discharge is kept between the first Y and Z sustain electrode lines YE1 and ZE1 and wall charges are formed in color pixel cells on the second line. If a contrary waveform of sustain pulse partially overlapped with the sustain pulse applied to the first-numbered first common terminal YIT1 is applied to the first-numbered second common terminal ZIT1, that is, if color pixel cells on the second line are driven, then wall charges allow a discharge to be kept between the second Y and Z sustain electrode lines YE2 and ZE2 by means of a low voltage. During maintaining the discharge between the second Y and Z sustain YE2 and ZE2, wall charges are formed in color pixel cells on the third line. In this manner, voltages of sustain pulses applied to the remaining 478 Y sustain electrode lines YE3 to YE480 and the remaining 478 Z sustain electrode lines ZE3 to ZE480 are lowered. Accordingly, the PDP can be driven with a low voltage and is capable of reducing a power consumption. Also, the sustain pulses generated at the Y sustain driver 140 and the sustain pulses generated at the Z sustain driver 150 have wavelengths incrementing by $2^n$ in proportion to a progress of the subfields. In other words, the sustain pulses have wavelengths of $2^0$, $2^1$, $2^2$, . . . , $2^6$, $2^7$ in the 1st to 8th subfields, respectively. A discharge generating between the Y sustain electrode line YE and the Z sustain electrode line ZE by the sustain pluses maintains for each interval corresponding to $2^0$, $2^1$, $2^2$, . . . , $2^6$, $2^7$ in accordance with a progress of the subfields.

Furthermore, the plasma display apparatus includes first and second address driver 161 and 162 for divisionally receiving panel picture data from the memory 130. The first address driver 161 drives 480 times 640 R address electrode lines RE1 to RE640 and odd-numbered G address electrode lines GE1, GE3, . . . , GE639. To this end, the first address driver 161 applies an erase pulse to all the 640 R address electrode lines RE1 to RE640 and odd-numbered G address electrode lines GE1, GE3, . . . , GE639 every subfield to thereby form wall charges on the surface of the R or G fluorescent material layers 14A and 14B included in each R color pixel cell and each odd-numbered G color pixel cell. Then, the first address driver 161 receives 480 times R address electrode lines RE1 to RE640 and odd-numbered G address electrode lines GE1, GE3, . . . , GE639 from the memory 130. This results from the 480 Y sustain electrode lines YE1, YE2, . . . , YE480 and the 480 Z sustain electrode lines ZE1, ZE2, . . . , ZE480 being driven sequentially for one line. In addition, each time R pixel data R1 to R640 and odd-numbered G pixel data G1, G3, . . . , G639 is inputted, the first address driver 161 selectively applies an address pulse to each R address electrode line RE1 to RE640 and each odd-numbered G address electrode line GE1, GE3, . . . , GE639 in accordance with a logical value of each pixel data, thereby selectively causing a discharge in each discharge space of the R color pixel cells and the odd-numbered G color pixel cells. The address pulse is generated in such a manner to be synchronized with a scan pulse stream only when a logical value of the pixel data is "1". The discharge selectively generating at each discharge space of the R color pixel cells and the odd-numbered G color pixel cells in the above manner is maintained during an interval in which the sustain pulse is being applied to the Y sustain electrode line YE and the Z sustain electrode line ZE. During the interval maintaining the discharge, discharge gases 17 contained in each discharge space of the R color pixel cells and the odd-numbered G color pixel cells emit ultraviolet lays 18 to brighten the R and G fluorescent layers 14A and 14B. The ultraviolet rays 18 are generated when electrons included in gas particles was excited and then transited. The electrons are excited by absorbing an energy generated when gas particles collide with respect to each other. As a result, each of R color pixel cells and odd-numbered G color pixel cells selectively emit R or G lights through the lower glass substrate 12. Likewise, the second address driver 162 drives 480 times 640 B address electrode lines BE1 to BE640 and even-numbered G address electrode lines GE2, GE4, . . . , GE640 every subfield. To this end, the second address driver 162 applies an erase pulse to all the B address electrode lines BE1 to BE640 and even-numbered G address electrode lines GE2, GE4, . . . , GE640 every subfield, to thereby form wall charges on the surface of the B or G fluorescent material layers 14C and 14B included in each B color pixel cell and each even-numbered G color pixel cell. Then, the second address driver 162 receives 480 times B pixel data B1 to B640 and even-numbered G pixel data G2, G4, . . . , G640 from the memory 130. To this end, the second address driver 162 applies an erase pulse to all the B address electrode lines BE1 to BE640 and even-numbered G address electrode lines GE2, GE4, . . . , GE640 every subfield, to thereby form wall charges on the surface of the B or G fluorescent material layers 14C and 14B included in each B color pixel cell and each even-numbered G color pixel cell. Then, the second address driver 162 receives 480 times B pixel data B1 to B640 and even-numbered G pixel data G2, G4, . . . , G640 from the memory 130. In addition, each time B pixel data B1 to B640 and even-numbered G pixel data G2, G4, . . . , G640 is inputted, the second address driver 162 selectively applies an address pulse to each B address electrode line BE1 to BE640 and each even-numbered G address electrode line GE2, GE4, . . . , GE640 in accordance with a logical value of each pixel data, thereby selectively causing a discharge in each discharge space of the B color pixel cells and the even-numbered G color pixel cells. The discharge selectively generating at each discharge space of the B color pixel cells and the even-numbered G color pixel cells in the above manner is maintained during an interval in which the sustain pulse is being applied to the Y sustain electrode line YE and the Z sustain electrode line ZE. During the interval maintaining the discharge, discharge gases 17 contained in each discharge space of the B color pixel cells and the even-numbered G color pixel cells emit ultraviolet lays 18 to brighten the R and G fluorescent layers 14C and 14B. As a result, each of R color pixel cells and even-numbered G color pixel cells selectively emit B or G lights through the lower glass substrate 12.

As described above, the color pixel cells included in the PDP 110 is selectively driven every subfield by means of the address drivers 161 and 162 and the sustain drivers 140 and 150, thereby generating R, G or B lights at each color pixel cell only during any one of 28 intervals in an interval when a single picture is displayed, that is, in one frame interval. In other words, a total amount of the R, G or B lights generated during one frame interval at each color pixel cell included in the PDP 110 has any one of $2^8$ scale levels. Thus, $2^8$ gray levels of R, G or B are displayed on each color pixel cell included in the PDP 110 and, therefore, $2^x$ gray levels of color picture is displayed on the PDP 10. Also, the R pixel data and the odd-numbered G pixel data is inputted to the first address driver 161 and the B pixel data and the even-numbered G pixel data, thereby reducing a cross talk among R, G and B data signals and a noise as well as simplifying input wiring of the address drivers 161 and the 162. As a result, a quality of the picture displayed on the PDP 110 can be improved.

Figure 7:
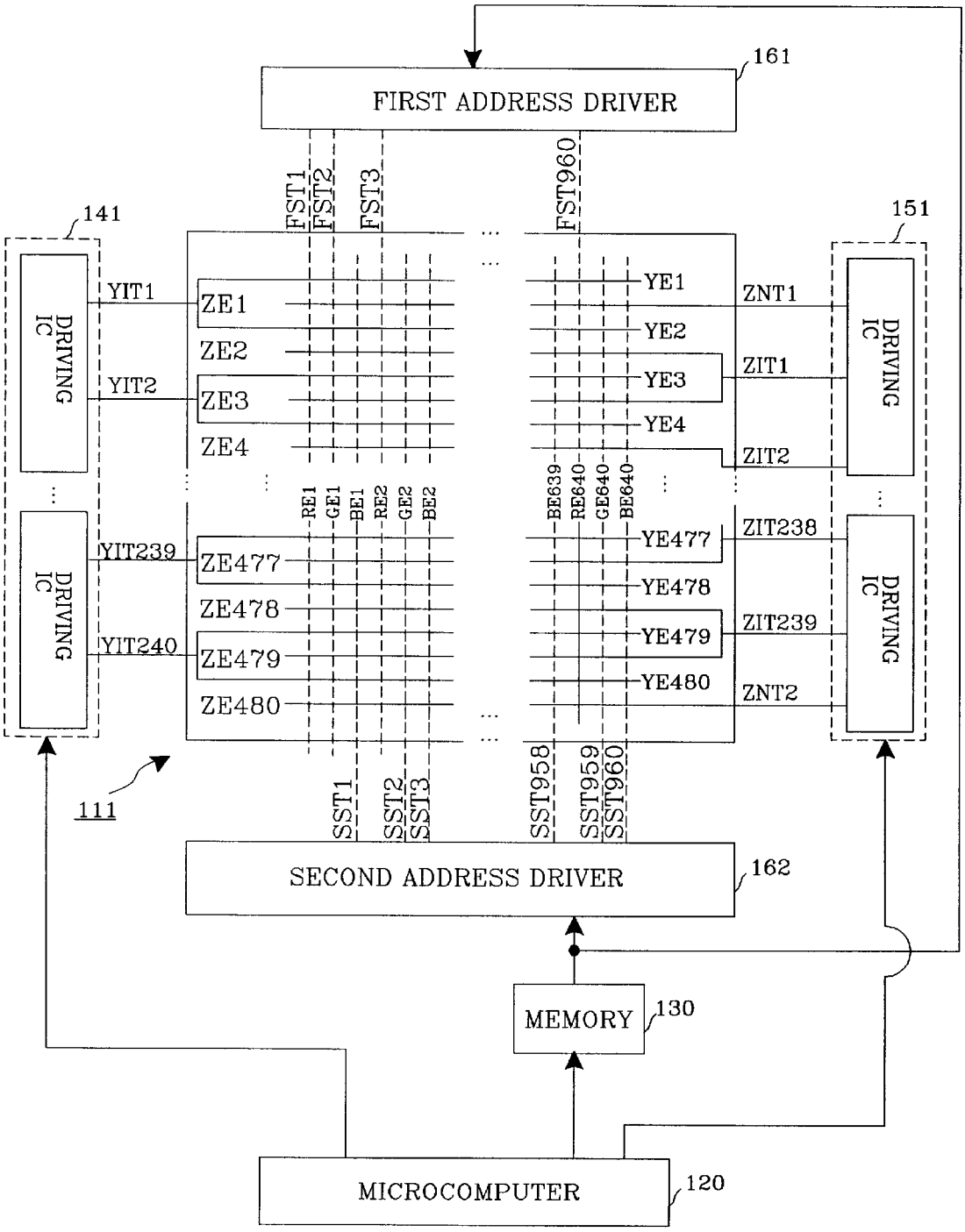
FIG. 7 is a schematic view showing a configuration of a plasma display apparatus according to another embodiment of the present invention.

Referring now to FIG. 7, there is shown a plasma display apparatus according to another embodiment of the present invention. The plasma display apparatus includes a PDP 111 having 480×640 pixels arranged in a matrix pattern, and a microcomputer 120 for receiving picture data containing R, G, and blue B pixel data. As shown in FIG. 2, each of 480×640 pixels included in the PDP 110 is composed of three color pixel cells, i.e., R, G, and B pixel cells. Thus, the PDP 111 includes 480×1920 color pixel cells. The PDP 111 further includes 480 Y sustain electrode lines YE1 to YE480 and 480 Z sustain electrode lines ZE1 to ZE480, and 680 R, G and B address electrode lines RE1 to RE680, GE1 to GE680 and BE1 to BE680, configured as shown in FIG. 5. A detailed explanation as to the PDP 111 will be omitted because it can be sufficiently supported by the foregoing explanations with reference to FIG. 2 and FIG. 5. Herein, it is assumed that each R, G and B pixel data inputted to the microcomputer 120 is composed of 8 bits. The microcomputer 120 converts the picture data into panel picture data and generates control signals. The panel picture data generated at the microcomputer 120 contains 8 subfield picture data SF1 to SF8 for one frame picture data corresponding to a single picture. In other words, one frame field picture data consist of 8 subfield picture data SF1 to SF8. Each color pixel cell on the PDP 111 is discharged or undischarged by the subfield picture data SF. The 8 subfield picture data SF1 to SF8 are made by separating 8 bits of R, G and B pixel data for each bit thereof by means of the microcomputer 120. Thus, the first subfield picture data SF1 contain the least significant bits of R, G, and B pixel data; the second subfield picture data SF2 contain the next order significant bits of R, G, and B pixel data; and the 8th subfield picture data SF8 contain the most significant bits of R, G, and B pixel data.

Further, the plasma display apparatus includes a memory 130 for temporarily storing the panel picture data from the microcomputer 120, and a Y sustain driver 141 and a Z sustain driver 151 for receiving control signals from the microcomputer 120. The memory 130 stores panel picture data while dividing the same for frame, for subfield (i.e., for bit) and for color thereof. The Y sustain driver 141 is responsive to the control signals from the microcomputer 120 to sequentially drive 480 Y sustain electrode lines YE1, YE2, . . . , YE480 every subfield. Specifically, the Y sustain driver 141 applies an erase pulse to all of first 240 common terminals YIT1 to YIT240 to thereby eliminate wall charges charged into a side wall of each color pixel cell in the previous subfield, and then applies a write pulse to all the first 240 common terminals YIT1 to YIT240 to thereby uniformly form wall charges in the side wall 13 of the PDP 111. Subsequently, the Y sustain driver 141 sequentially applies a sustain pulse to the first 240 common terminals YIT1 to YIT240 to thereby sequentially drive the color pixel cells on the PDP 111 for one line. The sustain pulse applied to each first common terminals YIT1 to YIT240 is commonly transferred to two Y sustain electrode lines YE1, YE2, YE4, YE5, . . . , YE478, YE479 connected in parallel. Thus, the sustain pulse applied to each first common terminals YIT1 to YIT240 has twice the width of conventional sustain pulse. To this end, the Y sustain driver 141 includes 80 Y driving IC chips. The 80 Y driving IC chips drive the 240 terminals YIT1 to YIT240 while dividing them into three units. Likewise, the Z sustain driver 151 is responsive to the control signals from the microcomputer 120 to sequentially drive 480 Z sustain electrode lines ZE1, ZE2, ZE480 every subfield. Specifically, the Z sustain driver 151 applies an erase pulse to all of second 239 common terminals ZIT1 to ZIT239 and two second normal terminals ZNT1 and ZNT2 to thereby eliminate wall charges charged into a side wall of each color pixel cell in the previous subfield, and then applies a write pulse to all the second 239 common terminals ZIT1 to ZIT239 and second two normal terminals ZNT1 and ZNT2 to thereby uniformly form wall charges in the side wall 13 of the PDP 111. The erase pulse and the write pulse generated at the Y sustain driver 141 has a contrary waveform to those generated at the Z sustain driver 151. The Z sustain driver 151 sequentially applies a sustain pulse to the second 239 common terminals ZIT1 to ZIT239 and second two normal terminals ZNT1 and ZNT2 to thereby sequentially drive the color pixel cells on the PDP 111 for one line. The sustain pulse applied to each second common terminal ZIT1 to ZIT239 is commonly transferred to two Z sustain electrode lines ZE2, ZE3, ZE5, ZE6, . . . , ZE479, ZE480 connected in parallel. On the other hand, the sustain pulse applied to each second normal terminal ZNT1 and ZNT2 is transferred to only one Z sustain electrode lines ZE1 and ZE480. Also, the sustain pulse applied to each second common terminals ZIT1 to ZIT239 has twice the period of each sustain pulse applied to each second normal terminal ZNT1 and ZNT2. The sustain pulse generated at the Z sustain driver 151 has a contrary waveform to the sustain pulse generated at the Y sustain driver 141. To this end, the Z sustain driver 151 includes 81 Z driving IC chips. The 81 Z driving IC chips drive the 241 terminals YIT1 to YIT239 and ZNT1 and ZNT2 while dividing them into three units. In this case, if sustain pulses having a contrary waveform and a different width are applied to the first-numbered first common terminal YIT1 and the first-numbered second normal terminal ZNT1, that is, if color pixel cells on the first line are driven, then a discharge is kept between the first Y and Z sustain electrode lines YE1 and ZE1 and wall charges are formed in color pixel cells on the second line. If a contrary waveform of sustain pulse partially overlapped with the sustain pulse applied to the first-numbered first common terminal YIT1 is applied to the first-numbered second common terminal ZIT1, that is, if color pixel cells on the second line are driven, then wall charges allow a discharge to be kept between the second Y and Z sustain electrode lines YE2 and ZE2 by means of a low voltage. During maintaining the discharge between the second Y and Z sustain YE2 and ZE2, wall charges are formed in color pixel cells on the third line. In this manner, voltages of sustain pulses to be applied to the remaining 478 Y sustain electrode lines YE3 to YE480 and the remaining 478 Z sustain electrode lines ZE3 to ZE480 are lowered. Accordingly, the PDP 111 can be driven with a low voltage and is capable of reducing a power consumption. Also, the sustain pulses generated at the Y sustain driver 141 and the sustain pulses generated at the Z sustain driver 151 have widths incrementing by 21 in proportion to a progress of the subfields. In other words, the sustain pulses have wavelengths of $2^0$, $2^1$, $2^2$, . . . , $2^6$, $2^7$ in the 1st to 8th subfields, respectively. A discharge generating between the Y sustain electrode line YE and the Z sustain electrode line ZE by the sustain pluses maintains for each interval corresponding to $2^0$, $2^1$, $2^2$, . . . , $2^6$, $2^7$ in accordance with a progress of the subfields.

Furthermore, the plasma display apparatus includes first and second address driver 161 and 162 for divisionally receiving panel picture data from the memory 130. Since the first and second address drivers 161 and 162 have the same structure and function as those shown in FIG. 6, an explanation as to them will be omitted.

In such a plasma display apparatus, the color pixel cells included in the PDP 111 is selectively driven every subfield by means of the address drivers 161 and 162 and the sustain drivers 141 and 151, thereby generating R, G or B lights at each color pixel cell only during any one of 28 intervals in an interval when a single picture is displayed, that is, in one frame interval. In other words, a total amount of the R, G or B lights generated during one frame interval at each color pixel cell included in the PDP 111 has any one of 28 scale levels. Thus, $2^8$ gray levels of R, G or B are displayed on each color pixel cell included in the PDP 110 and, therefore, $2^x$ gray levels of color picture is displayed on the PDP 111. Also, the R pixel data and the odd-numbered G pixel data is inputted to the first address driver 161 and the B pixel data and the even-numbered G pixel data, thereby reducing a cross talk among R, G and B data signals and a noise as well as simplifying input wiring of the address drivers 161 and the 162. As a result, a quality of the picture displayed on the PDP 111 can be improved.

As described above, in the PDP according to the present invention, any one side and/ or both sides of the Y sustain electrode lines and the Z sustain electrode lines is connected, in parallel, in two units by means of the common terminals, thereby lowering the frequency and voltage of a driving signal for driving each Y and Z sustain electrode lines as well as simplifying the Y sustain driving circuit. As a result, the PDP according to the present invention is capable of reducing the power consumption and the EMI as well as prolonging a life thereof. Also, in the PDP according to the present invention, R, G and B address electrode lines are connected to the first and second sink terminals for each color, thereby simplifying input wiring of the address drivers. Accordingly, the PDP according to the present invention is capable of reducing the cross talk among the color signals and the noise as well as improving the picture quality.

Further, in the plasma display apparatus according to the present invention, any one side and/or both sides of the Y sustain electrode lines and the Z sustain electrode lines is simultaneously driven in two units, thereby lowering the frequency and voltage of a driving signal for driving each Y and Z sustain electrode lines as well as simplifying the Y sustain driving circuit. As a result, the plasma display apparatus according to the present invention is capable of reducing the power consumption and the EMI as well as prolonging a life thereof. Also, in the plasma display apparatus according to the present invention, the address drivers divisionally drive R, G and B address electrode lines for each color, thereby simplifying input wiring of the address drivers. Accordingly, the plasma display apparatus according to the present invention is capable of reducing the cross talk among the color signals and the noise as well as improving the picture quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a plurality of pixel cells arranged in a matrix pattern and utilizing a discharge;

first and second sustain electrode lines arranged, in parallel and in pairs on the matrix to keep the discharge in the pixel cells;

red (R), green (G) and blue (B) address electrode lines arranged on the matrix in such a manner as to perpendicularly intersect with the first and second sustain electrode lines and correspond to R, G and B pixel cells;

first sink terminals that apply a driving signal to a first color address electrode lines and a portion of a second color address electrode lines; and second sink terminals that apply a driving signal to a third color address electrode lines and a remainder of the second color address electrode lines.

2. The plasma display panel as claimed in claim 1, further comprising:

signal transferring means for allowing electric charges to be charged in next line pixel cells during maintaining the discharge at one line of pixel cells.

3. The plasma display panel as claimed in claim 2, wherein said signal transferring means includes common terminals commonly connected to two electrode lines of the first sustain electrode lines.

4. The plasma display panel as claimed in claim 2, wherein said signal transferring means includes:

first common terminals commonly connected to two electrode lines of the first sustain electrode lines; and second common terminals commonly connected to two electrode lines of the second sustain electrode lines.

5. The plasma display panel as claimed in claim 4, wherein said first common terminals are sequentially arranged from a first-numbered first sustain electrode line; and said second common terminals are sequentially arranged from a second-numbered second sustain electrode line.

6. The plasma display panel as claimed in claim 4, wherein said first common terminals and said second common terminals are alternately arranged.

7. The plasma display panel as claimed in claim 6, wherein said signal transferring means includes:

first unit terminals connected to the second sustain electrode lines positioned between the first sustain electrode lines, said first sustain electrode lines being connected to the first common terminals; and second unit terminals connected to the first sustain electrode lines positioned between the second sustain electrode lines, said second sustain electrode lines being connected to the second common terminals.

8. A plasma display apparatus, comprising:

a plasma display panel having a plurality of pixel cells arranged in a matrix pattern and utilizing a discharge, first and second sustain electrode lines arranged on the matrix to keep a discharge in the pixel cells, and R, G and B address electrode lines arranged in such a manner as to perpendicularly intersect with the first and second electrode lines and correspond to R, G and B pixel cells;

first address driver means for driving a first color address electrode lines and a portion of a second color address electrode lines; and second address driver means for driving a third color address electrode lines and a remainder of the second color address electrode lines.

9. The plasma display apparatus as claimed in claim 8, further comprising:

sustain driver means for driving the first and second sustain electrode lines in such a manner that electric charges are charged in next line pixel cells during maintaining the discharge at one line pixel cells.

10. The plasma display apparatus as claimed in claim 9, wherein said sustain driver means includes common terminals for commonly applying a driving signal to two electrode lines of the first sustain electrode lines.

11. The plasma display apparatus as claimed in claim 9, wherein said sustain driver means includes:

first common terminals for commonly applying a first driving signal to two electrode lines of the first sustain electrode lines; and second common terminals for commonly applying a second driving signal to two electrode lines of the second sustain electrode lines.

12. The plasma display apparatus as claimed in claim 11, wherein said first common terminals arranged in such a manner that the first driving signal is sequentially applied from a first-numbered first sustain electrode line to the remaining first sustain electrode lines; and said second common terminals arranged in such a manner that the second driving signal is sequentially applied from a second-numbered second sustain electrode line to the remaining second sustain electrode lines.

13. The plasma display apparatus as claimed in claim 12, wherein said first common terminals and said second common terminals are alternately arranged.

14. The plasma display apparatus as claimed in claim 13, wherein said sustain driver means includes:

first unit terminals for applying the second driving signal to the second sustain electrode lines positioned between the first sustain electrode lines, said first sustain electrode lines being connected to the first common terminals; and second unit terminals for applying the first driving signal to the first sustain electrode lines positioned between the second sustain electrode lines, said second sustain electrode lines being connected to the second common terminals.

15. A circuit for driving a plasma display panel having a plurality of address electrode lines, a plurality of first and second sustain electrode lines arranged, in parallel, in a direction perpendicular to the address electrode lines, and a plurality of discharge cells formed at intersections of the address electrodes lines and the first and second electrode lines, the circuit comprising:

an address electrode driving portion that applies signals to the address electrode lines;

a first sustain electrode driving portion that connects together the first sustain electrode lines disposed adjacent to 3N numbered ones of the first sustain electrode lines, not including the 3N numbered lines, and applies scanning and sustain pulses to each of the first sustain electrode lines, the first electrode driving portion being positioned at one end of the plasma display panel; and a second sustain electrode driving portion that connects together the second sustain electrode lines disposed adjacent to the 3N+1 numbered ones of the second sustain electrode lines, not including the 3N+1 numbered lines, and applies scanning and sustain pulses to each of the second sustain electrode lines, the second electrode driving portion being positioned at another end of the plasma display panel, wherein N is an integer including 0.

16. The circuit as claimed in claim 15, wherein:

each of the address electrode lines consists of first to third sub-address electrode lines for displaying color data different from each other, and the address electrode driving portion includes:

a first address driver that applies sequentially data to one end of the first and second sub-address electrode lines of an address electrode line and the first sub-address electrode line of an adjacent address electrode line, starting from the first address electrode line; and a second address driver that applies sequentially data to another end of the third sub-address electrode line of the address electrode line and the second and third sub-address electrode lines of the adjacent address electrode line.

17. A circuit for driving a plasma display panel having a plurality of address electrode lines, a plurality of first and second sustain electrode lines arranged, in parallel, in a direction perpendicular to the address electrode lines, and a plurality of discharge cells formed at the intersections of the address electrodes lines and the first and second sustain electrode lines, the circuit comprising:

an address electrode driving portion that applies signals to the address electrode lines;

a first sustain electrode driving portion that connects the first sustain electrode lines, starting from the first line, by two lines adjacent to each other and applies scanning and sustain pulses to each of the first sustain electrode lines, the first electrode driving portion being positioned at one end of the plasma display panel; and a second sustain electrode driving portion that connects the second sustain electrode lines, starting from the second line, by two lines adjacent to each other and applies scanning and sustain pulses to each of the second sustain electrode lines, the second electrode driving portion being positioned at another end of the plasma display panel.

18. The circuit as claimed in claim 17, wherein:

each of the address electrode line consists of first to third sub-address electrode lines that display color data different from each other, and the address electrode driving portion includes:

a first address driver that applies sequentially data to one end of the first and second sub-address electrode lines of an address electrode line and the first sub-address electrode line of an adjacent address electrode line, starting from the first address line; and a second address driver that applies sequentially data to another end of the third sub-address electrode line of an address electrode line and the second and third sub-address electrode lines of the adjacent address electrode line.

* * * * *